United States Patent [19]

Bonomelli

[11] Patent Number: 4,676,176

[45] Date of Patent: Jun. 30, 1987

[54] FURNACE GRATE

[76] Inventor: Vaifro V. Bonomelli, Via de Amicis, 19, 20123 Milano, Italy

[21] Appl. No.: 794,176

[22] Filed: Nov. 1, 1985

[30] Foreign Application Priority Data

Oct. 11, 1985 [IT] Italy ..... 22458 A/85

[51] Int. Cl.[4] ..... F23K 7/04

[52] U.S. Cl. ..... 110/281; 110/285; 110/291; 126/174

[58] Field of Search ..... 110/290, 291, 288, 289, 110/279, 280, 281–285, 268; 126/152 R, 152 B, 163 R, 174–180

[56] References Cited

U.S. PATENT DOCUMENTS 807,766 12/1905 McClave ..... 110/285
2,173,883 9/1939 Preston et al. ..... 110/291
4,479,441 10/1984 Somodi ..... 110/291

FOREIGN PATENT DOCUMENTS 2311995 12/1976 France ..... 110/281

*Primary Examiner*—James C. Yeung
*Attorney, Agent, or Firm*—Darby & Darby

[57] ABSTRACT

This invention relates to a grate for burning solid combustibles and, more particularly, refuse in a fired furnace. The grate comprises a plurality of steps, each step including a plurality of adjacent grate bars with alternate steps of grate bars being movable relative to an adjacent step of stationary grate bars. Each grate bar includes a substantially horizontal platform terminating in a front lip, a pusher and means for pivotally mounting said pusher beneath the platform at a point near the back of the platform. The pusher includes a faceplate shaped to form an elongated channel with the undersurface of the lip to pass combustion air to said firing chamber. The relative position of the pusher and horizontal platform can be adjusted to vary the size of the air channel in order to adjust the amount of air fed to the firing chamber.

8 Claims, 5 Drawing Figures

FURNACE GRATE

BACKGROUND OF THE INVENTION

This invention relates to grates and, more particularly, to moving grates which transport refuse or other solid fuels through a combustion chamber in a furnace.

Step grates have been used for many years, as have reciprocating grates, to convey refuse through firing chambers. In reciprocating grates, alternating grate steps consisting of ten (for example) horizontally arrayed grate bars move horizontally to push refuse through the chamber. The refuse is oxidized during its transportation through the chamber and massive amounts of heat are produced. The oxidation, or more specifically, the combustion, is regulated by the quantity of oxygen (generally in the form of air) permitted in the chamber. To aid and regulate combustion, grate manufacturers have provided air vents in the grates. The air vents have also served to cool the grates. This is necessary because the grates can be exposed to direct flames and heat since they support the fuel bed.

Grate manufacturers have attempted to avoid two principle problems, namely, grate corrosion and incomplete combustion. Corrosion of the grate surface is caused principally by exposure of the grate bars to the excessive heat and flame emitted during the oxidation of combustible material during the operation of the furnace. Partial burning of combustible matter is due to loss of the material during its transportation because of openings between grates, either between adjacent grate bars of each grate step or successive steps. This can be a particularly serious problem in the case of certain types of refuse or refuse containing plastics which, if not properly burned, can produce pollutants such as dioxin.

Conventional grates do not satisfactorily avoid these problems. Typical grates contain air vents to cool each grate step and to facilitate combustion by providing the necessary amounts of oxygen at a particular location (i.e., to provide the primary air supply for the combustion). However, these air vents are subject to being clogged with partially burned material, dust or ashes and they can become difficult, if not impossible, to clean. Furthermore, cleaning time cuts into the time during which the furnace can operate and increases the costs of operation. Clogged air vents hamper the circulation of oxygen and therefore decrease the efficiency of the combustion. The cooling action of the air is also lessened and, as a result, the grate reaches temperatures which more readily corrode its surfaces. Conversely, when air coming from the vents produces combination flames, hot air pockets can be formed on the grate surface, causing substantial and serious corrosion. This becomes particularly serious when the air vents are positioned on the lower portion of the front surface of the step because developing flames go up and corrode the surface of the step causing the irregular enlargement of the air vents which can eliminate entirely the front of the grate bar. This allows a high volume of ashes, dust, and unburned or partially burned material to fall beneath the grate, which is particularly serious in the case of polluting refuse.

OBJECTS OF THE INVENTION

An object of the present invention is to remedy the problems outlined above. In particular, an object of the present invention is to provide a grate in which the surfaces and air vents are less likely to corrode than in the case of known grates and wherein the vents are not likely to get clogged. Additionally, it is an object to provide a grate bar which when placed alongside and above a similar grate bar, results in little or no partially burned matter, ashes, or dust being lost into the furnace.

SUMMARY OF THE INVENTION

In accordance with the invention, a grate bar comprises a horizontal plate for supporting the combustible matter and a pusher which is pivotally connected to the plate so that the plate and pusher define an air channel between them. Although the surface of the plate is initially smooth, after a short period of operation, the plate becomes coated with deposits which make its surface uneven. Hence, as the pusher moves horizontally across the plate of an adjacent step, as it scrapes material across the plate, it oscillates or vibrates due to its contact with the uneven surface.

The air inlet channel between the plate and the pusher of a particular grate bar is positioned at the upper portion of the pusher to prevent combustion flames from contacting the metal surface of the grate bar which would cause corrosion. The construction also prevents non-combusted or partially combusted material and ashes on the horizontal surface of the grate bar from entering into the air inlet channel and falling beneath the grate during the reciprocating movement of the grate bar.

DETAILED DESCRIPTION

Figure 1:
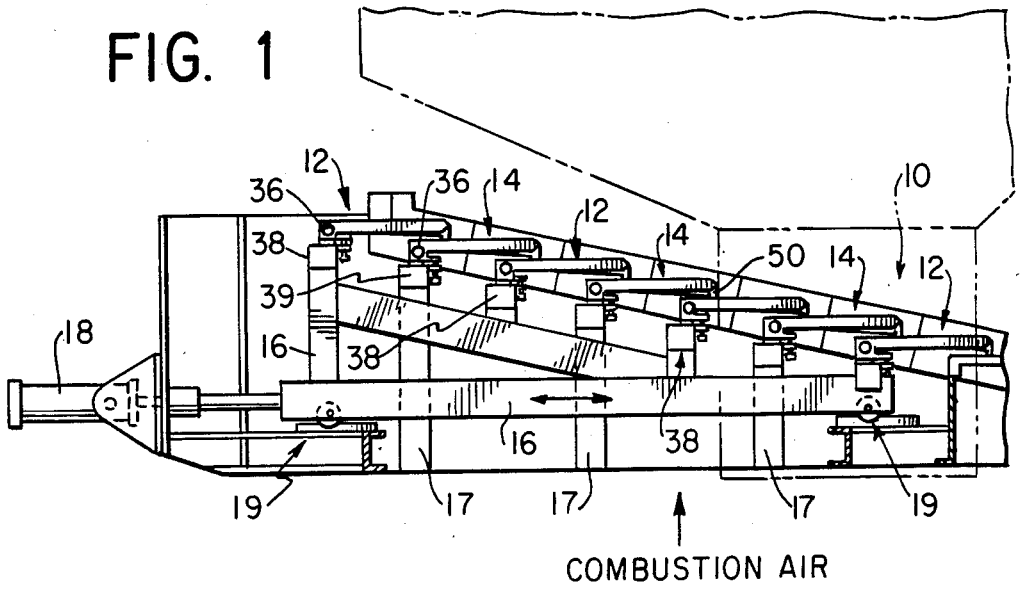
FIG. 1 is a diagrammatic side view partly in section of a grate according to the invention in conjunction with a refuse fired furnace.
Figure 2:
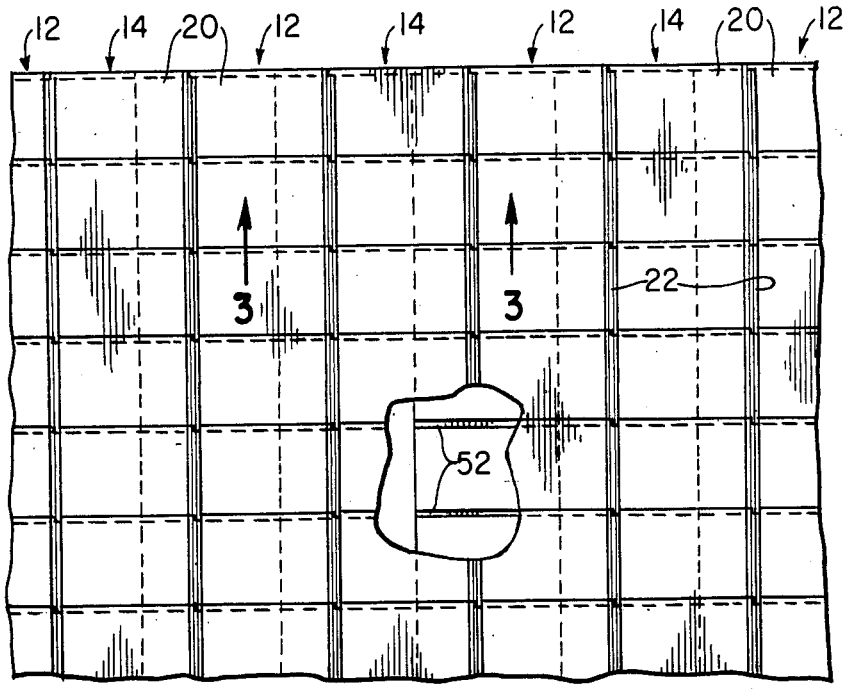
FIG. 2 is a plan view of several rows of grate bars according to the invention.

FIG. 1 shows in semi-diagrammatic form the structure of a grate as it would typically be used in a refuse fired furnace. The firing or combustion chamber of the furnace is shown at 10. The grate itself may be considered to comprise rows of movable grate bars 12 and a like number of rows of stationary grate bars 14 interspersed between the movable bars 12 to form a series of successive movable and stationary "steps". The movable grate bars 12 are mounted on a carriage 16 which is reciprocated by a hydraulic cylinder 18. Carriage 16 is supported on roller and track assemblies 19. The refuse is fed onto the grate by conventional means and combustion air is supplied to the firing chamber 10 from beneath the grate bars 12 and 14.

The structure for mounting the stationary grate bars 14 and for reciprocating the moving grate bars 12 may be conventional. Likewise, the apparatus used to supply the refuse to the grate bars and the means for providing the combustion air may be conventional. Accordingly, these structures have not been shown in detail in this specification.

As the refuse is supplied to the grate, it moves downwardly through the combustion chamber 10 under the influence of gravity and also because of the reciprocating movement of the grate bars 12 relative to fixed bars 14 which pushes the refuse or other fuel from step to step. If desired, the grate may include larger steps to form vertical drops which will assist in breaking and reorienting larger compacted bundles of refuse.

Different grate arrangements may be assembled by varying the mounting structure. Also, different slopes can be employed to reduce the maximum height or to facilitate transport of the refuse.

Conventional conveyors and hoppers may be used to remove ashes from the grate and, if necessary, from beneath the grate bars. Grate bars 12 and 14 may be cast from special chrome-nickel alloys or other alloys specially formulated to resist wear, warpage and burnout from the extreme furnace temperatures encountered.

Figure 3:
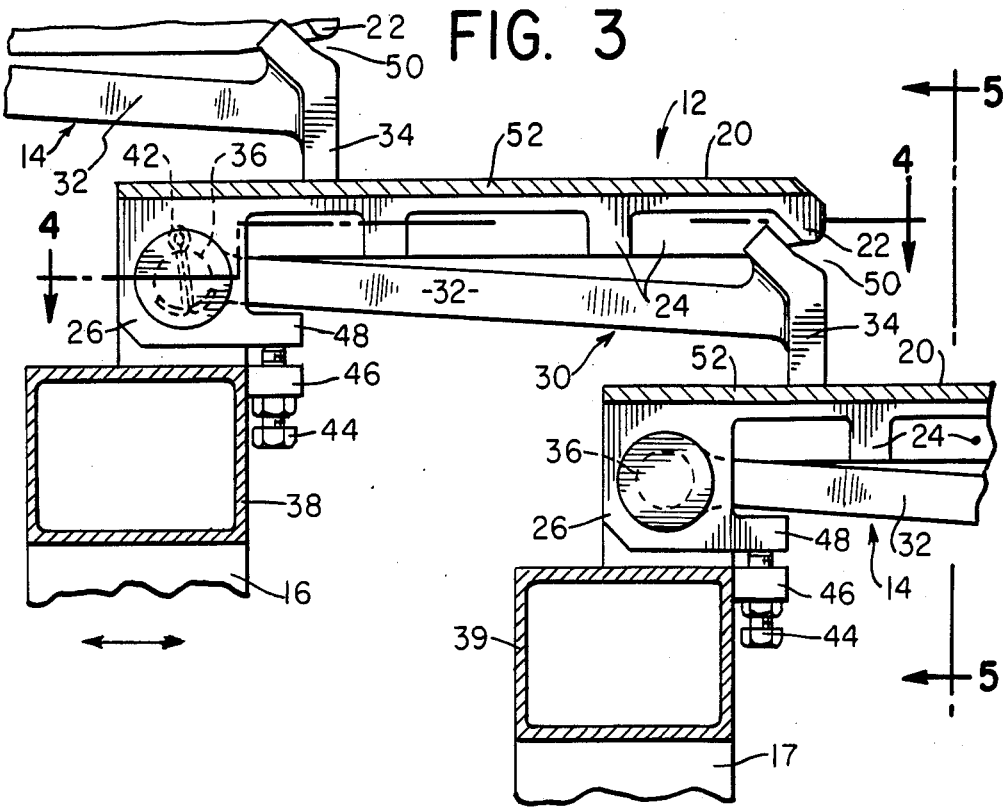
FIG. 3 is an enlarged detail section view taken substantially along the line 3—3 of FIG. 2.
Figure 4:
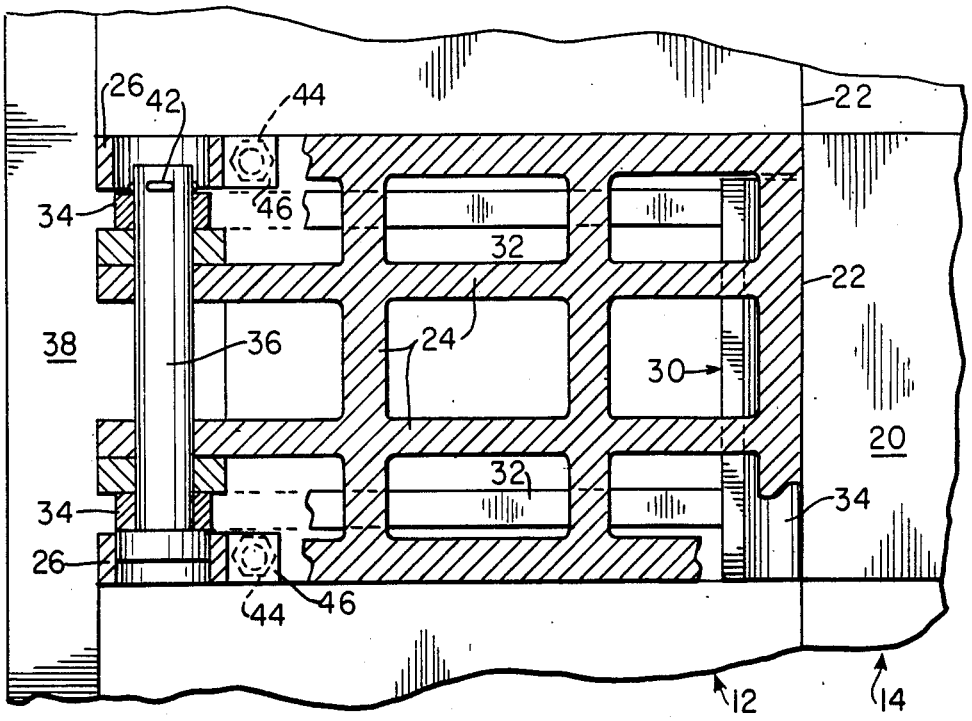
FIG. 4 is a sectional view taken substantially along the line 4—4 of FIG. 3.

The construction of the individual grate bars in accordance with the invention is shown most clearly in FIGS. 3 and 4. FIG. 3 shows the structure of one of the movable bars 12, but the stationary bars 14 have the identical construction. Each grate bar includes a horizontal platform 20 terminating in a forward lip 22 with structural crossribs 24 on the undersurface (see FIG. 4). A pair of mounting blocks 26 extend downwardly from the back edge of platform 20.

In accordance with the invention, a pusher 30 is pivotally mounted within the mounting blocks 26 of each bar 12. Each pusher 30 comprises two spaced apart arms 32 terminating in an angled faceplate 34 (see FIG. 3). The arms 32 contain bushings 35 which receive an axle 36. The axle 36, in turn, is secured within the mounting blocks 26 in any suitable fashion.

The grates 12 are mounted on horizontal channel members 38 which are fixed to the movable carriage 16. Vertical brackets 40 are fixed to channel members 38 through which axles 36 pass (FIG. 4). The construction is secured by a cotter pin 42 to simplify replacement of the grate bars. Similarly, stationary grate bars 14 are mounted on fixed channels 39, which in turn, are part of the stationary frame 17 of the overall structure.

Pairs of adjusting screws 44 are retained within a projection 46 extending from channel members 38 and 39. Adjusting screws 44 engage lugs 48 on the lower surface of one of the mounting blocks 26 so that the angular position of each of the platforms 20 can be adjusted for reasons explained below.

The upper portion of the pusher faceplate 34 is slanted as shown in FIG. 3 to form an elongated channel 50 with the lower surface of the front lip 22 of platform 20. This is an important feature of the invention and provides an inlet to the firing chamber for combustion air fed from beneath the grate bars. The size of this channel 50 may be adjusted by screws 44 which can vary the relative position of the platform 20 and the pusher 32. The shapes of the platform and pusher surfaces forming air channel 50 may be designed to create special aerodynamic effects to control the velocity and/or distribution of air through the channel.

Figure 5:
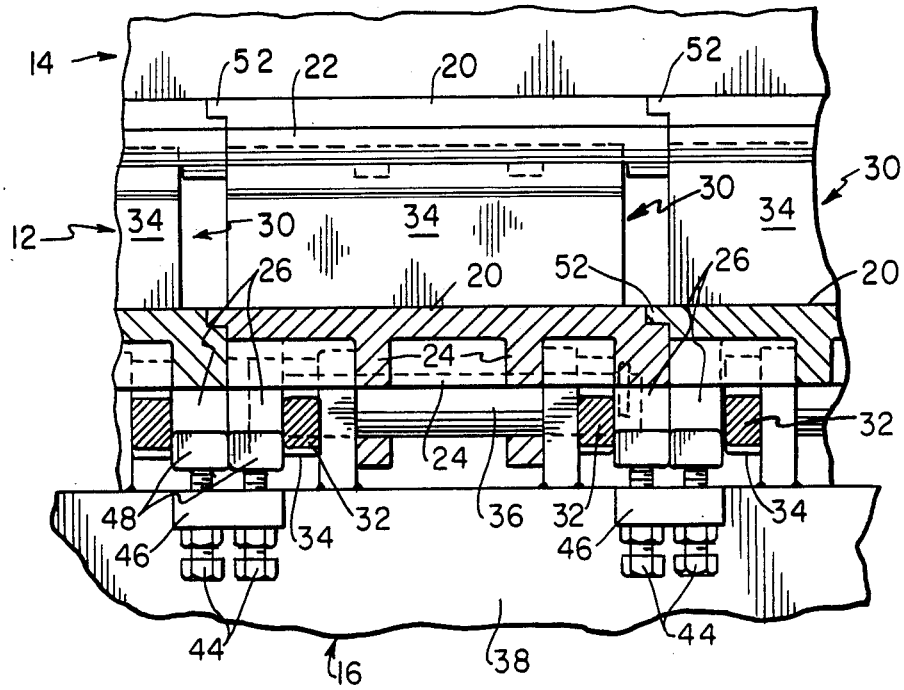
FIG. 5 is a sectional view taken substantially along the line 5—5 of FIG. 3.

In a typical grate, for example, each of the individual bars might be six inches or twelve inches wide and each single "step" might be formed by ten grate bars to obtain the desired width of the grate. In accordance with the invention, and as shown most clearly in FIG. 5, each horizontal platform includes a small horizontal projection 52 running its entire length and interlocking with a complementary recess (not numbered) in the horizontally adjacent platform. This reduces the likelihood that refuse or ash will drop between adjacent grate bars which, as indicated above, is a problem in furnaces of the type to which the invention pertains.

In operation of the furnace, combustion air is fed to the firing chamber through the elongated channels 50 formed between the horizontal platforms 20 and the faceplates 34 of the pushers 32, as described. The grate bars 12 are oscillated by cylinder 18 so that the pushers 32 force the refuse from step to step through the grate. As the upper portion of the horizontal platform 20 becomes uneven during use because of the formation of deposits, the pushers 32 tend to vibrate which helps to dislodge particles of matter that may have found their way into the air channel 50. Because clogging is reduced, the cooling effect of the air on the grate bars is enhanced, thereby prolonging their useful life.

Moreover, the construction of the faceplate of the pusher 30 is such that the air channel is formed substantially above the major portion of the vertical portion of faceplates 34. Hence, these vertical portions of the grate bars are not subject to the extreme temperature in the firing chamber since combustion for the most part occurs above the air opening defined by the outlet of channel 50. Hence, corrosion of these vertical surfaces is diminished.

What is claimed is:

1. A grate bar for use in a furnace wherein movable grate bars are oscillated relative to stationary grate bars for the purpose of conveying fuel through a firing chamber, comprising:

a substantially horizontal platform terminating in a downwardly extending front lip, and a pusher pivotally rounted beneath the platform, said pusher including a faceplate, said front lip overlying the upper section of the faceplate to form a downwardly sloped, horizontally elongated channel between the undersurface of said front lip and the upper section of said faceplate through which combustion air can be passed to said firing chamber, the horizontal platform and pusher having no openings in the surface exposed to the fuel through which ash particles can pass.

2. A grate bar according to claim 1, wherein said pusher includes at least one approximately horizontal arm extending from said faceplate to the back of said platform, and means pivotally mounting said horizontal arm near the back of the platform.

3. A grate bar according to claim 2, wherein said platform includes downwardly depending cross ribs.

4. A grate bar according to claim 1, wherein the forward portion of said pusher includes a substantially vertical section beneath the opening of the elongated channel and a rearwardly upper section arranged beneath the bottom of said lip to define one wall of said elongated channel.

5. For use in burning refuse in a refuse fired furnace, a grate comprising a plurality of steps, each step comprising a plurality of grate bars with alternate steps of grate bars being movable relative to the next lower step of stationary grate bars, each of said steps comprising a mounting member, said grate bars including a substantially horizontal platform terminating in a front lip, a pusher and means for pivotally mounting said pusher beneath the platform at a point near the back of the platform, said pusher including a faceplate, said front lip overlying the upper section of the faceplate to form a downwardly sloped, horizontally elongated channel between the undersurface of said lip and the upper section of said faceplate to pass combustion air to said firing chamber, the horizontal platform and pusher having no openings in the surface exposed to the fuel through which ash particles can pass, each such faceplate resting on the horizontal platform of a grate bar of the next lower step.

6. A grate according to claim 5, wherein said means for pivotally mounting comprises an axle cooperating with said mounting means, said horizontal platform and said pusher.

7. A grate according to claim 6, including means for adjusting the relative positive of said pusher and horizontal platform for the purpose of adjusting the size of the channel to adjust the amount of air fed to the firing chamber.

8. A grate bar according to claim 5, wherein the forward portion of said pusher includes a substantially vertical section beneath the opening of the elongated channel and a rearwardly sloping upper section arranged beneath the bottom of said lip to define one wall of said elongated channel.

* * * * *